United States Patent [19]

Albertsen

[11] Patent Number: 4,553,527

[45] Date of Patent: Nov. 19, 1985

[54] CATALYTIC UNIT FOR BURNERS

[75] Inventor: Peter S. Albertsen, Warwick, R.I.

[73] Assignee: Nu-Tec Incorporated, East Greenwich, R.I.

[21] Appl. No.: 580,663

[22] Filed: Feb. 16, 1984

[51] Int. Cl.[4] ..... F23J 15/00

[52] U.S. Cl. ..... 126/58; 126/77; 126/109; 126/112; 110/203; 110/210

[58] Field of Search ..... 126/58, 77, 83, 99 A, 126/109, 112; 110/203, 210, 211

[56] References Cited

U.S. PATENT DOCUMENTS

| | | | |
|---|---|---|---|
| 4,279,629 | 7/1981 | Simms | 126/292 |
| 4,373,452 | 2/1983 | Van Dewoestine | 110/203 |
| 4,373,507 | 2/1983 | Schwartz et al. | 126/289 |
| 4,422,437 | 12/1983 | Hirschey | 110/211 |
| 4,466,421 | 8/1984 | Dorsch et al. | 126/285 |

FOREIGN PATENT DOCUMENTS

| | | | |
|---|---|---|---|
| 2085153 | 4/1982 | United Kingdom | 110/210 |

*Primary Examiner*—Samuel Scott
*Assistant Examiner*—Helen A. Odar

[57] ABSTRACT

Apparatus supporting a catalytic converter for a burner comprising a support including an opening for passage of exhaust gases therethrough, a catalytic converter mounted on the support for movement into and out of an operating position adjacent to the opening to receive the exhaust gases, and means extending from the support for causing the catalytic converter to be moved into and out of the operating position.

3 Claims, 4 Drawing Figures

CATALYTIC UNIT FOR BURNERS

FIELD OF THE INVENTION

The invention relates to apparatus for supporting a catalytic converter for a burner.

BACKGROUND OF THE INVENTION

Burners such as wood burning stoves can be provided with catalytic converters to treat exhaust gases. It is desirable to also provide the burners with mechanisms to permit by-passing the converters, e.g., during starting of fires.

SUMMARY OF THE INVENTION

It has been discovered that a burner can be desirably provided with a catalytic converter and a by-pass mechanism by providing a support having an opening for passage of exhaust gases therethrough, a catalytic converter mounted on the support for movement into and out of an operating position adjacent to the opening, and means extending from the support for causing the catalytic converter to be moved into and out of position.

In preferred embodiments the catalytic converter is slidably mounted on the support between a pair of guide walls defining two regions, one region being adjacent to the opening and the other region not being adjacent to the opening; the converter is slid into and out of position by flexible tension members (e.g., chains) connected to each side of the converter and extending from the support; the tension members pass through guide members that are positioned on the support to cause rotation of the catalytic converter during sliding from one position to another; and the catalytic converter includes an active converting means mounted in a slidable housing.

DESCRIPTION OF THE PREFERRED EMBODIMENT

The structure and operation of the preferred embodiment of the invention will now be described after first briefly describing the drawings.

DRAWINGS

STRUCTURE

Figure 1:
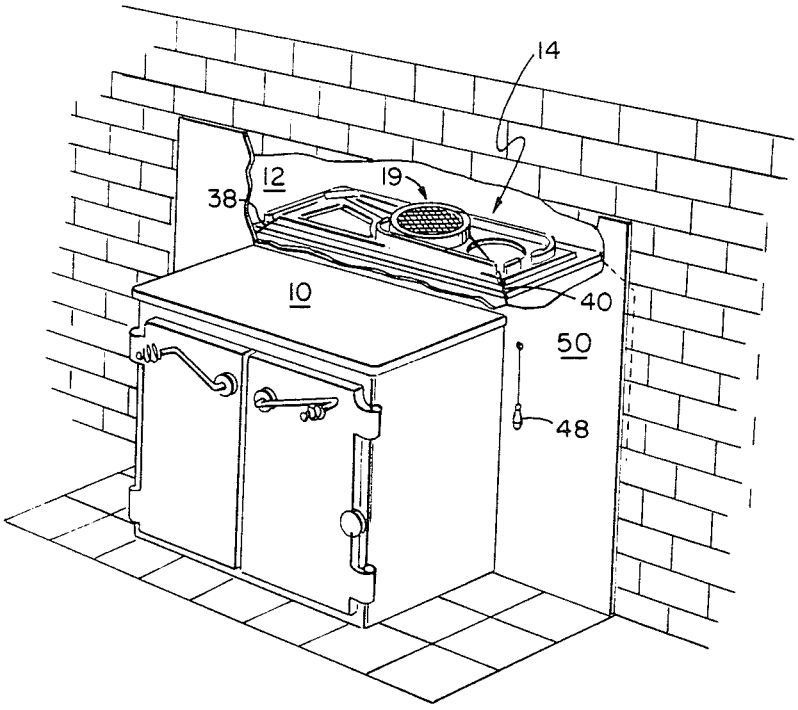
FIG. 1 is a diagrammatic perspective view of a wood burning stove mounted in a fireplace and including apparatus for supporting a catalytic converter according to the invention.

Referring to the figures, there is shown wood burning stove 10 mounted in fireplace cavity 12 and having catalytic converter supporting apparatus 14 fixedly mounted on a rear portion of stove 10 in cavity 12. Apparatus 14 includes base plate support 16 having opening 18 over a hole in wood burning stove 10 to receive exhaust gases therethrough and to permit them to pass upward through the chimney passage of the fireplace. Slidably mounted on support 16 is catalytic converter 19, including slide housing 20 and interior active converting means 22 supported on stainless steel screen 24 extending across lip 26 of slide housing 20.

Figure 4:
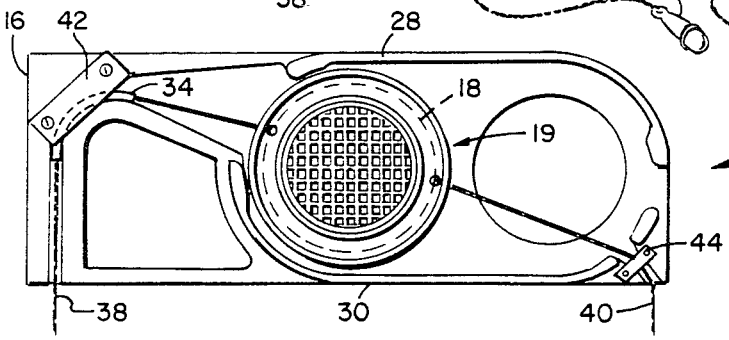
FIG. 4 is a plan view of said apparatus.

Wrapped around converting means 22 is heat expanding gasket 27. Base plate support 16 has guide walls 28, 30 for guiding slide housing 20 and groove 32 (in which is mounted tube 34) and groove 36 for receiving chains 38, 40 connected to slide housing 20. As is seen in FIG. 4, chains 38, 40 are connected to the perimeter of slide housing 20 at positions that are less than 180° from each other. Retaining plate 42 holds tube 34 in place, and retaining plate 44 prevents removal of chain 40 from groove 36. Handles 46, 48 are connected to the ends of chains 38, 40 and extend from side plates 50 of stove 10 (handle 46 and chain 38 not being shown in FIG. 1).

Active converting means 22 is 5.4 inches in diameter, 1.5 inches in height, has 0.2 inch by 0.2 inch square cross-sectional passages extending from its lower surface to its upper surface and defined by walls that are 0.020 to 0.025 inch thick and is made of Cordierite with a palladium based catalyst. Base plate support 16 is made of cast iron, as are slide housing 20 and handles 46, 48.

Operation

Figure 2:
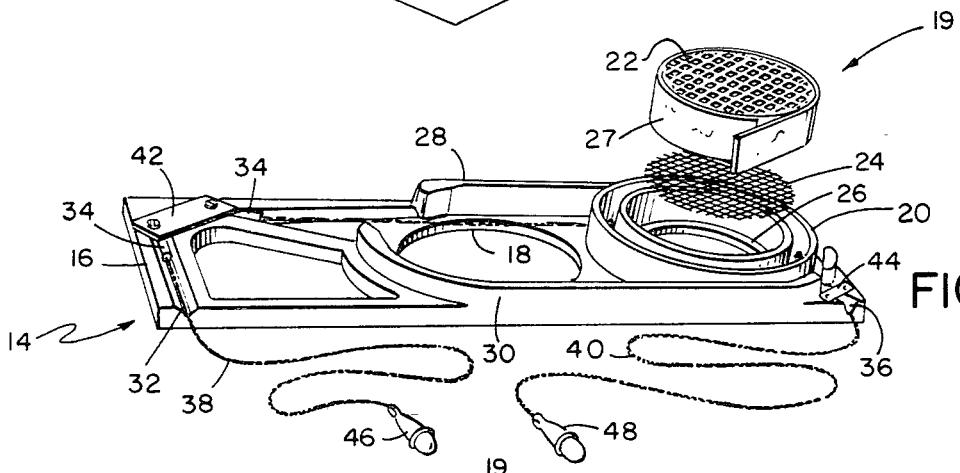
FIG. 2 is an exploded perspective view of said apparatus with said converter in a by-pass position.
Figure 3:
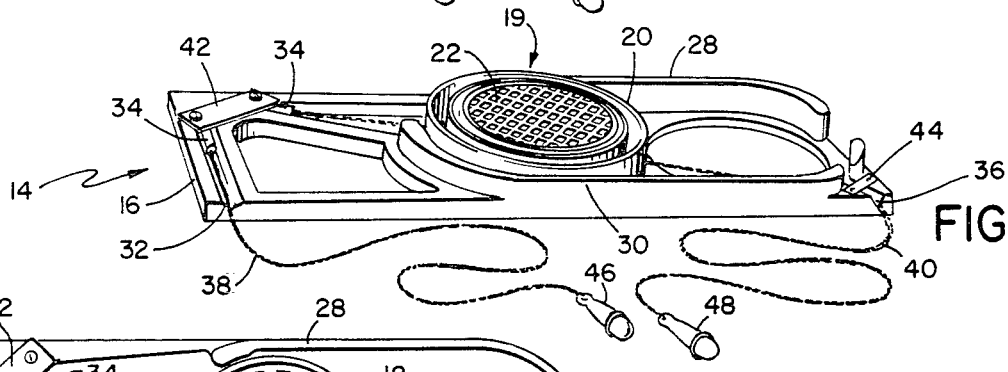
FIG. 3 is a perspective view of said apparatus with said converter in an operating position.

In operation, converter 19 is in the by-pass position shown in FIG. 2 while a fire is started in stove 10. Once the fire is burning well, and the chimney is heated so that a good draft is established, catalytic converter 19 is moved into the operating position over hole 18 by pulling on handle 46, causing chain 38 to move housing 20 to the left, rotating slightly during initial sliding between walls 28, 30. This slight rotation makes it easier to initiate sliding of slide housing 20 and is caused by the positions of tube 34 and groove 36 and the location of attachment of chains 38, 40 to housing 20. When in the position of FIG. 3, exhaust gases passing through opening 18 also pass through converter 19, the portions of the lower surface of housing 20 surrounding the hole through it providing a seal with underlying portions of support 16 surrounding opening 18. When it is desired to put the converter into the by-pass position, one pulls handle 48, causing chain 40 to pull converter 20 back to the position shown in FIG. 2. Once again, in travel from the position of FIG. 3 to the position of FIG. 2, there is initial rotation of housing 20, making it easier to slide housing 20.

Other Embodiments

Other embodiments of the invention are within the scope of the following claims.

What is claimed is:

1. Apparatus supporting a catalytic converter for a combustion chamber having an exhaust opening and including an upper wall and a front wall, said apparatus comprising a support for mounting across a rear portion of said upper wall of said combustion chamber having said exhaust opening, said support including an opening for positioning over said exhaust opening for passage of exhaust gases therethrough, said support also including a pair of guide walls defining an operating region over said exhaust opening and a nonoperating region horizontally adjacent to said operating region along said rear portion of said burner, said support having a horizontal sliding axis that passes through said operating region and said nonoperating region and is parallel to said front, a catalytic converter mounted on said support for sliding movement between said operating and non-operating reions along said sliding axis, and a pair of flexible tension members connected to opposite sides of said converter and extending from said support for causing said catalytic converter to be moved between said operating and nonoperating regions, said flexible tension members being connected such that pulling one said flexible tension member causes said converter to move along said sliding axis in one direction, and pulling the other said flexible tension member causes said converter to move along said sliding axis in the opposite direction.

2. The apparatus of claim 1 wherein said support includes guide means for guiding said flexible tension members, and wherein said guide means are positioned, and said flexible tension members are connected to said converter, in a manner causing rotation of said converter during sliding between said two regions.

3. The apparatus of claim 2 wherein said converter is circular in shape, and said flexible tension members are attached to said converter at positions such that the angle between the positions of attachment is less than 180°.

* * * * *